US012618556B2

(12) United States Patent
Kattelus et al.

(10) Patent No.: US 12,618,556 B2
(45) Date of Patent: May 5, 2026

(54) BURNER AND BOILER-BURNER ASSEMBLY

(71) Applicant: Oilon Technology Oy, Lahti (FI)

(72) Inventors: Joonas Kattelus, Lahti (FI); Lassi Karvonen, Lahti (FI)

(73) Assignee: Oilon Technology Oy, Lahti (FI)

( * ) Notice: Subject to any disclaimer, the term of this patent is extended or adjusted under 35 U.S.C. 154(b) by 518 days.

(21) Appl. No.: 18/133,647

(22) Filed: Apr. 12, 2023

(65) Prior Publication Data

US 2023/0324042 A1 Oct. 12, 2023

Related U.S. Application Data

(60) Provisional application No. 63/329,969, filed on Apr. 12, 2022.

(51) Int. Cl.
*F23D 14/06* (2006.01)
*F23D 14/10* (2006.01)
(Continued)

(52) U.S. Cl.
CPC ..... *F23D 14/065* (2013.01); *F23D 14/10* (2013.01); *F23D 14/32* (2013.01); *F23D 14/58* (2013.01);
(Continued)

(58) Field of Classification Search
CPC ..... F23D 11/107; F23D 14/62; F23D 14/02; F23D 14/065; F23D 14/10; F23D 14/32; F23D 14/58; F23D 14/70; F23C 7/004
(Continued)

(56) References Cited

U.S. PATENT DOCUMENTS 3,329,131 A * 7/1967 Wright ..... F22B 7/12 431/185
3,672,812 A * 6/1972 Bendixen ..... F23D 14/00 431/89
(Continued)

FOREIGN PATENT DOCUMENTS

CN 108019774 A 5/2018
CN 111720820 A 9/2020
(Continued)

OTHER PUBLICATIONS

Finland Search Report, Application No. 20225319, dated Oct. 10, 2022.
(Continued)

*Primary Examiner* — Vivek K Shirsat
(74) *Attorney, Agent, or Firm* — MacMillan, Sobanski & Todd, LLC

(57) ABSTRACT

A burner (1) installable to a furnace (9) for burning an air-fuel mixture and for generating a flame in the furnace (9), said burner (1) comprising a frame member (6) provided with an elongated combustion head (2) protruding from said frame member (6) and being adaptable inside the furnace (9), what in a view from the burner's (1) frame member (6) is a distal end (2*a*) of said combustion head (2) being adaptable to generate both a main flame (B) and a primary flame (E), said combustion head (2) comprising an outer, larger diameter channel (3) for a mixture (80) of combustion air and fuel, as well as a smaller diameter, inner channel (4), surrounded by said outer channel (3), for primary air (60) as well as for primary gas (70), whereby the inner channel (4) extends from the burner's frame member (6) to the distal end (2*a*) and comprises an inner tube (4, 41) for primary gas (70) and an outer tube
(Continued)

(4; 42) surrounding said inner tube (4; 41), wherein a flow space (4; 43) for primary air (60) is provided between the outer side of the jacket (41*a*) of said inner tube and the inner side of the jacket of the outer tube, and which combustion head's (2) outer channel (3) extends from the burner's frame member (6) to the combustion head's distal end (2*a*) and can be provided with a supply of premixed air-fuel mixture (80) from the burner's frame member (6), or from that section of the combustion head (2) which is associated with the frame member and located, in the flowing direction of the premixed air-fuel mixture (80), upstream of a combustion chamber (90), for generating the main flame B).

In said burner the space delimited by the outer wall (31) of the outer channel (3) and the jacket of the outer tube (42) of the inner channel (4) is constructed as a discharge channel (10) extending from the frame member (6) to the distal end (2*a*) of the combustion head (2), whereby the discharge end (10*a*) of said discharge channel is veered away from the longitudinal center line (P) of the combustion head (2) so that the center line (10A) of said discharge end (10*a*), or an extension thereof, forms an inclined angle of incidence (t) with the combustion head's (2) longitudinal center line (P), said angle of incidence (t) being 90-140 degrees as said discharge end (10*a*) of the discharge channel (10) is viewed from the direction of the burner's (1) frame member (6), a flow controller (7) is provided in the flow space (4; 43) for primary air, at the distal end (2*a*) of the combustion head (2), for directing the flow of primary air (60) in the flow space (43) so that the primary air (60) flows from the flow controller (7) towards the mouth (43*a*) of the flow space (43), in the vicinity of the jacket (42*a*) of the outer tube (4; 42) of the inner channel (4), a plurality of nozzles (8) is provided in the inner tube (4; 41) of the inner channel (4), at the distal end (41*a*) of said inner tube (4) in the flowing direction of the primary gas (70), for directing the primary gas (70) into the flow space (4; 43), either upstream or downstream of the flow controller (7) in the flowing direction of the primary air (60).

21 Claims, 3 Drawing Sheets

(51) Int. Cl.
*F23D 14/32* (2006.01)
*F23D 14/58* (2006.01)
*F23D 14/70* (2006.01)

(52) U.S. Cl.
CPC ..... *F23D 14/70* (2013.01); *F23D 2203/007* (2013.01)

(58) Field of Classification Search
USPC ..... 431/89, 182–185
See application file for complete search history.

(56) References Cited

U.S. PATENT DOCUMENTS

| | | | | | |
|---|---|---|---|---|---|
| 3,694,136 | A * | 9/1972 | Flournoy | F23D 11/408 | 431/182 |
| 4,383,820 | A * | 5/1983 | Camacho | F23D 14/36 | 239/406 |
| 4,561,841 | A * | 12/1985 | Korenyi | F23D 11/408 | 431/351 |
| 4,588,375 | A * | 5/1986 | Sandstrom | F23D 11/001 | 431/115 |
| 4,595,355 | A * | 6/1986 | Garrelfs | F23D 11/001 | 431/183 |
| 5,145,359 | A * | 9/1992 | Ancona | F23C 9/00 | 431/278 |
| 5,147,199 | A * | 9/1992 | Perthuis | F23D 14/24 | 431/183 |
| 5,169,304 | A * | 12/1992 | Flament | F23C 7/004 | 431/183 |
| 5,192,204 | A * | 3/1993 | Musil | F23D 11/107 | 239/404 |
| 5,380,194 | A * | 1/1995 | Polomchak | F23D 14/02 | 431/185 |
| 5,415,539 | A * | 5/1995 | Musil | F23C 7/004 | 239/404 |
| 5,700,143 | A * | 12/1997 | Irwin | F23D 17/002 | 431/182 |
| 5,813,846 | A * | 9/1998 | Newby | F23D 14/24 | 431/9 |
| 6,085,739 | A * | 7/2000 | Leiss | F23D 11/26 | 431/154 |
| 6,238,206 | B1 | 5/2001 | Cummings, III et al. | | |
| 6,368,101 | B1 * | 4/2002 | Briggs | F23G 7/05 | 239/406 |
| 8,561,602 | B2 * | 10/2013 | Andors | F24C 3/006 | 431/185 |
| 11,428,414 | B2 | 8/2022 | Bland et al. | | |
| 2002/0115033 | A1 * | 8/2002 | Hallit | F23D 14/48 | 431/351 |
| 2002/0197574 | A1 | 12/2002 | Jones et al. | | |
| 2006/0057518 | A1 * | 3/2006 | Aldrich | F23D 14/66 | 431/115 |
| 2006/0281036 | A1 * | 12/2006 | Sarv | F23D 17/002 | 431/185 |
| 2014/0308619 | A1 * | 10/2014 | Wartluft | F23D 14/62 | 431/9 |
| 2019/0264910 | A1 * | 8/2019 | Nett | F23R 3/286 | |
| 2025/0109851 | A1 * | 4/2025 | Hanz | F23D 14/145 | |

FOREIGN PATENT DOCUMENTS

| | | | |
|---|---|---|---|
| CN | 111853775 | A | 10/2020 |
| DE | 3606625 | A1 | 9/1986 |
| EP | 3734154 | A1 | 11/2020 |
| GB | 2483476 | A | 3/2012 |
| WO | 2021203583 | A1 | 10/2021 |

OTHER PUBLICATIONS

The extended European Search Report, Application No. 23167527.3, dated Sep. 18, 2023.
Chinese First Office Action, dated Jul. 26, 2025, Application No. 202310391224.9.

* cited by examiner

BURNER AND BOILER-BURNER ASSEMBLY

The invention relates to a burner according to the preamble of claim 1 capable of being installed in a furnace for burning a premixed air-fuel mixture.

The invention relates also to a furnace-burner assembly according to claim 16 for burning a premixed air-fuel mixture.

So-called premix burners are used for burning a mixture of premixed fuel and air. These burners are intended to attain low NOx emission levels. Particularly premix burners with a long combustion head, intended to attain low NOx emissions (less than 9 ppm NOx emissions in flue gases) without substantial oxygen excesses, are disclosed in the prior art, i.a. in the publication U.S. Pat. No. 6,238,206. This prior known burner model is provided with a combustion head associated with the frame and extending a long way into the interior of a furnace and the low NOx emissions require oxygen excesses of less than 12% or especially less than 6%. The biggest downside of this burner has nevertheless been found to be a continuously relatively high NOx emission level, not completely fulfilling the stringent emission standards of e.g. certain states in the United States provided that the burner is to be operated efficiently, in other words, with low oxygen excesses. The Applicant's own US application discloses this type of burner capable of reaching low emissions but being limited in its compatibility with commercially available furnaces.

The invention is intended to provide an improvement regarding the foregoing prior art or at least to alleviate the drawbacks existing in the above-described prior art. Therefore, a first objective of the invention is to provide a high-efficiency burner installable to a furnace, as well as a furnace-burner assembly in which a premixed air-fuel mixture can be combusted by the burner with oxygen excesses of less than 3% in such a way that the average NOx emissions in flue gases remain below 15 ppm, and with oxygen excesses of less than 7% in such a way that the average NOx emissions in flue gases remain below 5 ppm. It was a particular objective of the invention to attain a NOx level of less than 2.5 ppm with oxygen excesses of less than 8% by means of flame stabilization and phasing of mixture ratios.

A second objective of the invention was to provide a burner more readily installable to commercially available furnaces, as well as a furnace-burner assembly obtainable thereby.

The above objectives are attained with a burner of claim 1 capable of being installed to a furnace for burning a premixed air-fuel mixture, as well as with a furnace-burner assembly of claim 16 for burning an air-fuel mixture and for generating a flame in a combustion chamber inside the furnace.

More specifically, the invention relates to a burner of claim 1 installable to a furnace for burning an air-fuel mixture and for generating a flame in the furnace. The burner comprises a frame member provided with an elongated combustion head protruding from said frame member and being adaptable inside the furnace, what in a view from the burner's frame member is a distal end of said combustion head being adapted to generate both a main flame and a primary flame, said combustion head comprising an outer, larger diameter channel for a mixture of combustion air and fuel, as well as a smaller diameter, inner channel, surrounded by the outer channel, for primary air as well as for primary gas. Hence, the combustion head's inner channel extends from the burner's frame member to the distal end and comprises an inner tube for primary gas and an outer tube surrounding said inner tube, wherein a flow space for primary air is provided between the outer side of the jacket of said inner tube and the inner side of the jacket of the outer tube, and the combustion head's outer channel extends from the burner's frame member to the combustion head's distal end and can be provided with a supply of premixed air-fuel mixture from the burner's frame member, or from that section of the combustion head which is associated with the frame member and located, in the flowing direction of the premixed air-fuel mixture, upstream of a combustion chamber, for generating a main flame (B).

The space between the outer wall of the outer channel and the jacket of the outer tube of the inner channel is constructed as a discharge channel extending from the frame member to the distal end of the combustion head, whereby the discharge end of said discharge channel is turned away from the longitudinal center line of the discharge end so that the center line of said discharge end, or an extension thereof, forms an inclined angle of incidence with the combustion head's longitudinal center line, said angle of incidence being 90-140 degrees as said discharge end of the discharge channel is viewed from the direction of the burner's frame member.

A flow controller is provided in the flow space for primary air, at the distal end, for directing the flow of primary air in the flow space so that the primary air flows from the flow guide towards the mouth of the flow space, in the vicinity of the jacket of the outer tube of the inner channel, a plurality of nozzles is provided in the inner tube of the inner channel, at the distal end of said inner tube in the flowing direction of the primary gas, for directing the primary gas into the flow space, either upstream or downstream of the flow controller in the flowing direction of the primary air.

In a furnace-burner assembly of the invention for burning an air-fuel mixture and for generating a flame in a combustion chamber present inside the furnace, the burner has been defined in claim 1 and connected to the furnace in such a way that inside the furnace's combustion chamber is left a second section of the elongated combustion head, which protrudes from the frame member and which combustion head has its first section left outside the furnace or connected to structures of the furnace. A main flame is generable by conducting a premixed air-fuel mixture into the discharge channel, from whose mouth said fuel-air mixture discharges into the furnace at an angle, which is 90-140 degrees as said mouth of the discharge channel is viewed from the direction of a center line passing through its end on the side of the burner's frame.

A main flame (B) is generable by conducting a premixed air-fuel mixture into the discharge channel, from the mouth of discharge channel's discharge end said fuel-air mixture discharges into the combustion chamber, the center line of said discharge end forming an inclined angle of incidence, which angle is about 90-140 degrees, with a longitudinal center line of the combustion head, as well as also with a longitudinal center line of the discharge channel, as said discharge end of the discharge channel is viewed from the direction of the burner's frame member.

A primary flame (E) is generable by providing the flow space with a supply of primary air from the burner's frame member or from that section of the combustion head which is associated with the frame member and located, in the primary air flowing direction, upstream of the combustion chamber, for conveying the flow of primary air to a flow controller which is adapted to direct the flow of primary air to pass towards the mouth of the flow space co-directionally with the main flame, and by providing the inner channel's inner tube with a supply of primary gas from the burner's frame member or from that section of the combustion head which is located, in the primary air flowing direction, upstream of the combustion chamber, whereby the nozzles of a plurality of nozzles in the proximity of the inner tube's free end are adapted to direct the discharge of primary gas from the combustion head's mouth into the flow space.

The present invention is based on the combustion head being made up of two nested channels. In the outer channel, i.e. the discharge channel, a premixed air-gas mixture is passed, discharging into a combustion chamber from a discharge channel's discharge end, which becomes narrower and veers away as viewed from a center line of the combustion head. The discharge channel's cross-sectional area diminishes in the traveling direction of the air-gas mixture when proceeding towards the discharge end's mouth, which is located at the combustion head's mouth.

The cross-section of the discharge channel is continuously reduced, reaching its minimum at the mouth of the discharge channel. This gives the advantage that the premixed air-gas mixture (main flow) is continuously accelerated in the discharge channel. The maximum flow rate of the main flow is thus reached at the mouth of the discharge channel.

Primary air and primary gas flow in the inner channel. The primary air is directed towards the combustion head's mouth by way of a flow controller, such as vanes, co-directionally with the main flame. The flow controllers direct the primary air to flow from the flow controller towards the mouth of the flow space, in the vicinity of the jacket of the outer tube of the inner channel. In this way, the path of the primary air from the flow controller towards the mouth of the flow space can be directed to follow the curvature of the inner wall of the discharge channel, away from the center line of the combustion head.

The primary gas travels in the inner channel in its own tube and is directed to the combustion head's mouth by means of nozzles.

In the burner, the intensity of flame and the amount of air are adjusted, and the adjustment is precise and has a strong effect on the main flame. It is by virtue of good adjustability that the burner is better-than-before compatible with diverse applications and combustion chambers. In particular, the burner is more compatible than before with water-tube boilers and other special applications.

It is by virtue of the more reliable adjustment that the novel burner enables attainment of the emission limit of 5 ppm with acceptable stability in combustion chambers more diverse than before. In addition to this, the novel concept enables attainment of a NOx level of less than 2.5 ppm with oxygen excesses of less than 8% by virtue of the further optimized flame stabilization and phasing of mixture ratios (see also Table 1). It is by virtue of the innovative combustion head design that the risk of occurring backfire, typical for premix burners, is minimized, thus improving both safety and convenience of use.

The invention and benefits attainable thereby will next be illustrated in even more detail with reference to the accompanying drawings.

Next follows a brief review of those aspects of a burner, as well as a furnace-burner assembly, of the invention which are detailed in each FIGS. 1, 2A, 2B, and 2C.

Figure 1:
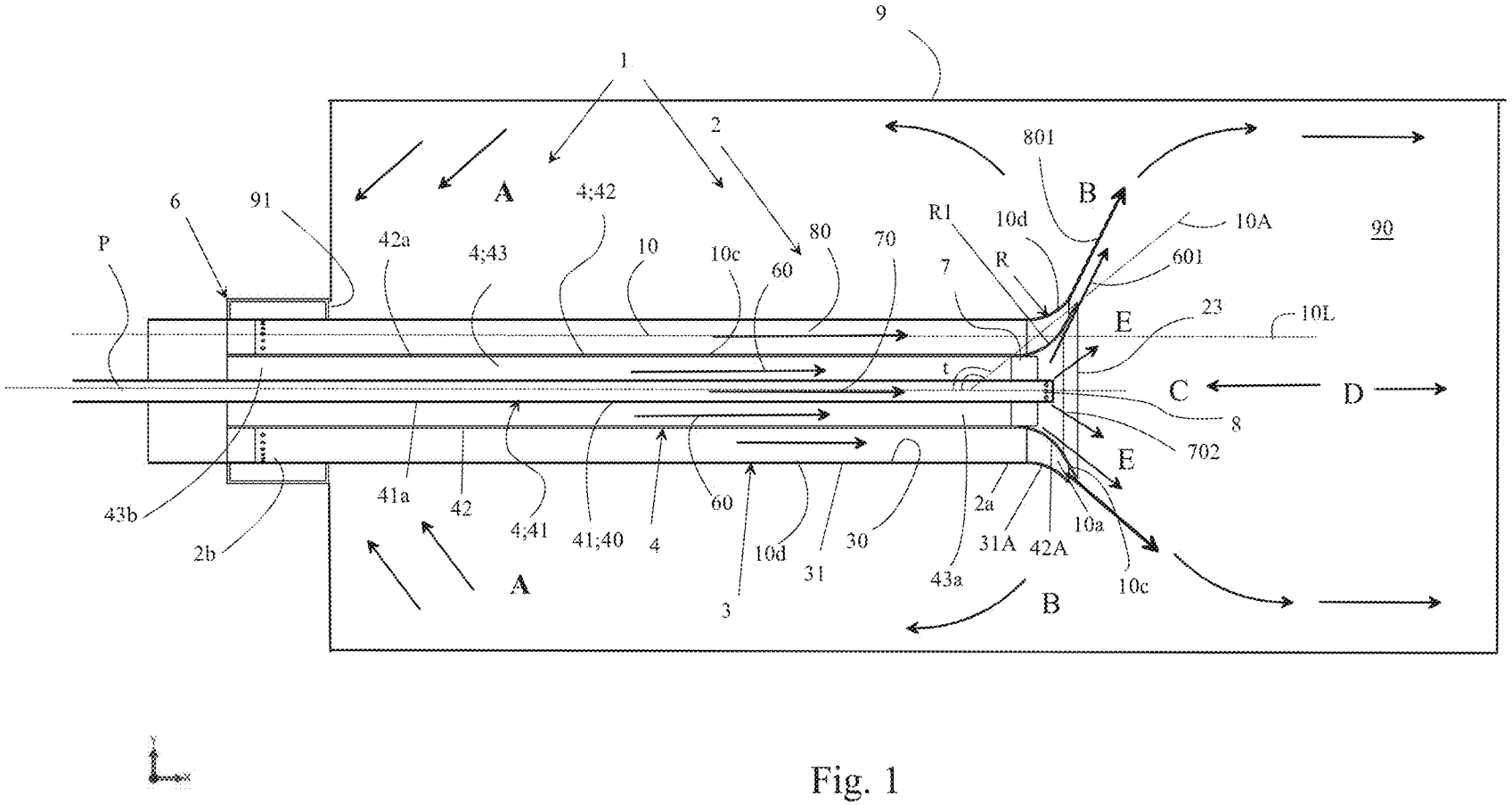
FIG. 1 shows, in a section view, a frame member of one burner embodiment, as well as a combustion head associated therewith.

FIG. 1 shows, in a longitudinal section view, a burner 1 whose combustion head 2 extends into a furnace 9. The combustion head 2 is, in general, cylindrical and has an annular cross-sectional profile. FIG. 1 also displays how a flame A, B, C, D, E, established inside the furnace, is generated in the burner-furnace assembly by burning an air-fuel mixture 80 directed to a mouth 23 of the combustion head (generation of a main flame B) or primary air 60 or primary gas 70 (generation of primary flame E). FIG. 1 shows with arrows the advancing direction of the air-fuel mixture 80, primary air 60, and primary gas 70 in the combustion head 2.

The burner 1 in FIG. 1 is installed in the furnace 9 in such a way that the combustion head's 2 mouth 23 opens into an interior 90 of the furnace 9 and the burner's frame member 6 attaches to the furnace 9 by way of a flange 91.

The burner's 1 elongated combustion head 2 protrudes from the frame member 6, and in the interior 90 of the furnace 9 have been generated a main flame B and a primary flame E, which are located downstream of a mouth 23 of what in a view from said frame member 6 is a distal end 2*a* of the combustion head 2. The buildup of other flame zones (A, C, D) will be described later.

The combustion head 2 comprises an outer, larger diameter channel 3 for a mixture 80 of combustion air and fuel, as well as a smaller diameter, inner channel 4, surrounded by the outer channel 3, for primary air 60 as well as for primary gas 70.

The combustion head's 2 inner channel 4, which is surrounded by the combustion head's 2 outer channel 3, has been provided with supplies of primary gas 70 and primary air 60. The combustion head's inner channel 4 extends from the burner's frame member 6 all the way to the mouth 23 of the combustion head's 2 distal end 2*a*.

The combustion head's 2 inner channel 4 comprises an inner tube 4; 41 for a gaseous fuel (primary gas) 70 and an outer tube 4; 42. The outer tube 4; 42 surrounds said inner tube 4; 41 in a ring-shaped way. A flow space 4; 43 for primary air 60 is left between an external surface 41*a* of the jacket 40 of the inner tube 41 (i.e. the side of the jacket 41 of the inner tube 41 of the inner channel 4 facing the outer tube 4; 42) and an internal surface of the jacket 42*a* of the outer tube 4; 42 (i.e. the side of the jacket 40 of the outer tube facing the inner tube) is left. The flow space 4; 43 is thus limited in the direction of the outer channel 3 by the jacket of the outer tube 4; 42 of the inner channel 4 which is thus the inner wall of the outer channel 3.

This annular flow space 43 between the inner channel 4, the outer tube 42 and the inner tube 41 is now provided with a supply of primary air 60 from the frame member 6 of the burner 1, or from that section 2*b* of the combustion head 2 which is in communication with the frame member 6 and is located upstream of the combustion chamber 90 in the flowing direction of primary air 60.

Thus, primary air 60 flows in the flow space 43, from the end 43*b* of said flow space 43 on the side of the frame member 6 of the burner 1 all the way to the mouth 43*a* of the flow space. The mouth 43*a* of the flow space 43 is located at the distal end 2*a* of the combustion head 2. The mouth 43*a* of the flow space 43 is part of the mouth 23 of the combustion head 2, into which primary air 60 is passed through said flow space and primary gas 70 is arranged to flow via the inner tube 41 of the inner channel 4.

The mouth 23 of the combustion head 2 is divided into a discharge end 10*a* of the discharge channel 10, and a combined mouth 43*a* for the flow space 43, in which primary gas 70 flows via the inner tube 41 and primary air 60 flows via the flow space 43.

The free end of the discharge channel 10, facing the mouth 23 of the combustion head 2, comprises a discharge end 10*a*, whose mouth opens into the mouth 23 of the distal end 2*a* of the combustion head 2. The discharge channel 10 will be described in more detail below.

The mouth 43*a* of the flow space 43 of the inner channel 4 is limited, seen from the center line of the combustion head, i.e. in the radial direction of the combustion head 2, by the discharge end 10*a* of the discharge channel 10, particularly the distal end of the jacket 42*a* of the outer tube 42.

A flow controller 7 is installed at the mouth 43*a* of the flow space 43 of the inner channel 4, located at the free end of the flow space, seen from the frame member 6 of the burner 1, and constituting a part of the mouth 23 of the distal end 2*a* of the combustion head. The flow controller 7 is thus located at the distal end 2*a* of the combustion head 2, seen from the frame member 6 of the burner, close to the mouth 23 of the combustion head 2.

The flow space 4; 43 for primary air 60 extends from the burner's 1 frame member 6 to the mouth 23 of what (in a view from the frame member 6) is the combustion head's 2 distal end 2*a*. The outer tube's 4; 42 jacket 42*a* of the inner channel 4 constitutes at the same time a boundary surface between the inner channel 4 and the outer channel 3 and separates flow space 43 and discharge channel 10 from each other.

As stated above, the jacket 42*a* of the outer tube 4; 42 of the inner channel 4 also separates the discharge end 10*a* of the discharge channel 10 and the mouth 43*a* of the flow space 43 from each other at the mouth 23 of the combustion head 2.

Viewed from the frame member 6 of the burner 1, the outer end 42A of the outer tube 42 of the inner channel 4, that is, the free end 42A, is arranged to veer outward, i.e. in the direction of a free end 31A of the outer channel's 3 external wall 31, as viewed from the longitudinal center line of the combustion head 2. The centre of the radius of curvature is located outside the combustion head 2.

As seen in FIG. 1, the jacket 42 of the outer tube 42 of the inner channel 4, limiting the flow space 43, extends approximately in parallel with the center line P of the combustion head 2 of the burner all the way to the flow controller 7 located in the flow space 43 of the inner channel. The distal end 42A i.e. the free end 42A of the jacket 42*a* of the outer tube 42 of the inner channel 4, extending downstream of the flow controller 7 in the flow direction of primary air 60, veers away from the center line P of the combustion head 2 towards the outer wall 31 of the outer channel 3. In this way, the distal end 42A of the outer tube 42 of the inner channel 4 is directed away from the center line P of the combustion head 2 in the radial direction of the combustion head 2.

To put it more precisely, said free end 42A of the external wall of the jacket 42*a* of the outer tube 42 of the inner channel 4 is located on such a circular arc whose radius is R1, the center of said circular arc being located outside the combustion head 2.

In this context, the distal end 42A or free end 42A of the outer tube 42 of the inner channel 4 refers to that part of the outer tube 42 which is placed at the outer end 2*a* of the combustion head 2, approximately downstream of the flow controller 7, seen from the frame member 6 of the burner.

The flow controller 7 directs the flow of primary air 60 in the flow space 43 to pass co-directionally with the main flame B when said primary air 60 exits the flow space 43. The structure and the function of the flow controller 7 are shown in more detail below in FIGS. 2A to 2C.

The outer channel 3 of the combustion head, in turn, extends from the frame member of the burner 1 to the mouth 23 of the distal end 2*a* of the combustion head 2. The outer wall 31 of the outer channel 3 simultaneously constitutes the outer wall of the combustion head 2. The free end 3A of the outer channel 3, that is, the free end 31A of the outer wall of the outer channel, veers outwards seen from the center line 10L of the discharge channel 10, that is, away seen from the center line P of the combustion head (cf. FIG. 1) by a radius of curvature R. The center of the radius of curvature R is also preferably located outside the combustion head 2.

The space remaining between an internal side 30 of the outer channel's 3 external wall 31 as well as an external side of the jacket 42 of the inner channel 42 constitutes a discharge channel 10, in which travels a premixed air-fuel mixture 80 for generating a main flame B. The jacket 42A of the outer tube defines the inner channel 4 and thereby serves simultaneously as the outer wall of the inner channel 4. The discharge channel 10 has its free end, which is closer to the combustion head's 2 mouth 23, comprising a discharge end 10*a* whose mouth is a part of the mouth 23 of the combustion head's 2 distal end 2*a*.

The distal end 42A of the jacket 42*a* of the outer tube 42 of the inner channel 4, serving as the inner surface of the discharge end 10*a* of the discharge channel 10, and the outer wall 31 of the outer channel 3, serving as the outer surface of the discharge end 10*a* of the discharge channel 10, thus veer towards each other and simultaneously away from the center line P of the combustion head, when the combustion head is seen from the direction of the frame member 6. Thus, the combustion end 10*a* has a trumpet-like appearance at the mouth 23 of the combustion head 2, and the cross-section of the discharge end 10*a* of the discharge channel 10 decreases continuously, reaching its minimum at the mouth of the discharge channel 10.

This provides the advantage that the premixed air-gas mixture (main flow) is continuously accelerated at the discharge end 10*a* of the discharge channel. The maximum flow rate of the main flow is thus achieved at the mouth of the discharge end 10*a*.

As mentioned above, the free ends 31A and 42A of the discharge channel's 10 external wall 31 and the discharge channel's internal wall, i.e. those of the outer tube's 42 jacket 42*a*, have both a "trumpet-like" general appearance at the combustion head's 2 distal end 2*a*. Hence, the respective free ends 31A and 42A of the discharge channel's 10 external wall 31 and the discharge channel's internal wall 42*a* curve respectively outward from the discharge channel's center line 10L as well as from the combustion head's center line P, the radii of curvature thereof being respectively R and R1, wherein R and R1 are equal or unequal. The centers of these radii R and R1 of curvature are located outside the combustion head.

In a preferred embodiment of the invention, the centers of the radii R and R1 of curvature are located, seen from the frame member 6 of the burner, on the side of the such a cross-sectional plane of the center line P of the combustion head, facing the mouth 23 of the combustion head 2, which extends approximately via the flow controller 7 located at the distal end of the combustion head 2.

Since the free end 31A of the discharge channel's 10 external wall 31 and the free end 42A of the discharge channel's internal wall 42*a* curve outward as seen from the discharge channel's 10*a* center line 10L and as seen from the combustion head's 2 center line P, respectively, the entire discharge end 10*a* is directed away as seen from the combustion head's center line P.

Since the discharge channel 10*a* in itself is ring-shaped, the discharge channel's center line 10L refers here to what is a ring-shaped center line 10L of the ring-shaped discharge channel 10*a* as seen in a longitudinal section of the discharge channel (cf. FIG. 1). Thus, an angle of incidence between the center line 10L of the discharge channel's 10 discharge end 10*a* (in a longitudinal section of the discharge end) and the combustion head's 2 longitudinal center line P is an inclined angle of incidence t. The same inclined angle of incidence t is also formed between the center line 10A of the discharge end 10*a* and the discharge channel's 10 (its longitudinal section) center line 10L. Said inclined angle of incidence t is approximately 90-140 degrees when viewing said angle of incidence t between the center line 10A of the discharge end and the longitudinal center line P of the combustion head and the discharge end 10*a* of the discharge channel 10 from the direction of the burner's 1 frame member 6.

Generally, the free end 42A of the discharge channel's 10 internal wall 42 (the free end 42A of the outer tube 42), which has a radius of curvature R1, arches more vigorously than the free end 31A of the discharge channel's 10 external wall 31, which has a radius of curvature R, whereby R>R1. Hence, the discharge channel's 10 entire discharge end 10*a* becomes narrower and turns outward when proceeding in the traveling direction of a premixed air-gas mixture 80 towards the mouth of the discharge channel's 10 discharge end 10*a*, which is a part of the combustion head's mouth 23 (cf. FIG. 1). As a result, the cross-sectional area of the discharge channel's 10 discharge end 10*a* diminishes in the traveling direction of the premixed air-gas mixture 80 when proceeding towards the discharge end's 10*a* mouth, which is located at the combustion head's 2 mouth 23.

This provides that the flow rate of the premixed air-gas mixture 80 flowing in the discharge channel is continuously accelerated when passing towards the mouth of the discharge end 10*a*. The flow rate and the magnitude of its acceleration will depend on the angle of incidence 5 between the center line 10A of the discharge channel and the longitudinal center line P of the combustion head, as well as on the mutual relationship between the radii R and R1 of curvature.

It is by virtue of the novel design of the discharge channel's 10 discharge end 10*a* that the risk of causing backfire, typical for premix burners, has been minimized, thereby improving both safety and convenience of use.

The outer channel's 3 discharge channel 10 is provided with a supply of premixed air-fuel mixture 80 for generating a main flame B visible in FIG. 1. The premixed air-fuel mixture 80 arrives in the outer channel's 3 discharge channel 10 from the frame member 6, or from a section 2*b* of the combustion head 2 associated with the frame member and located, in the flowing direction of the premixed air-fuel mixture, upstream of a combustion chamber 90.

What in the flowing direction of a primary gas 70 is a distal end 41*a* of the inner tube 4; 41 is in turn provided with a plurality of nozzles 8 for conducting the primary gas 70 into a flow space 4; 43 and then to the mouth 43*a* of the flow space 43. The primary gas is conveyed into the flow space in the flowing direction of a primary air 60 upstream or downstream of a flow deflector 7 located at a free end 43 of the flow space 43. The inner channel's 4 inner tube 4; 41 is provided with a supply of primary gas 70 from the burner's 1 frame member 6, or from that section 2*b* of the combustion head 2 which is associated with the frame member 6 and located, in the flowing direction of primary gas 70, upstream of the combustion chamber 90.

The primary flame E is generated as primary air 60 introduced into the flow space 43 and the flow of primary gas 70 merge with each other after the mouth of the flow end of the flow space 43. The flow space mouth is a part of the combustion head's 2 mouth 23.

Figure 2A:
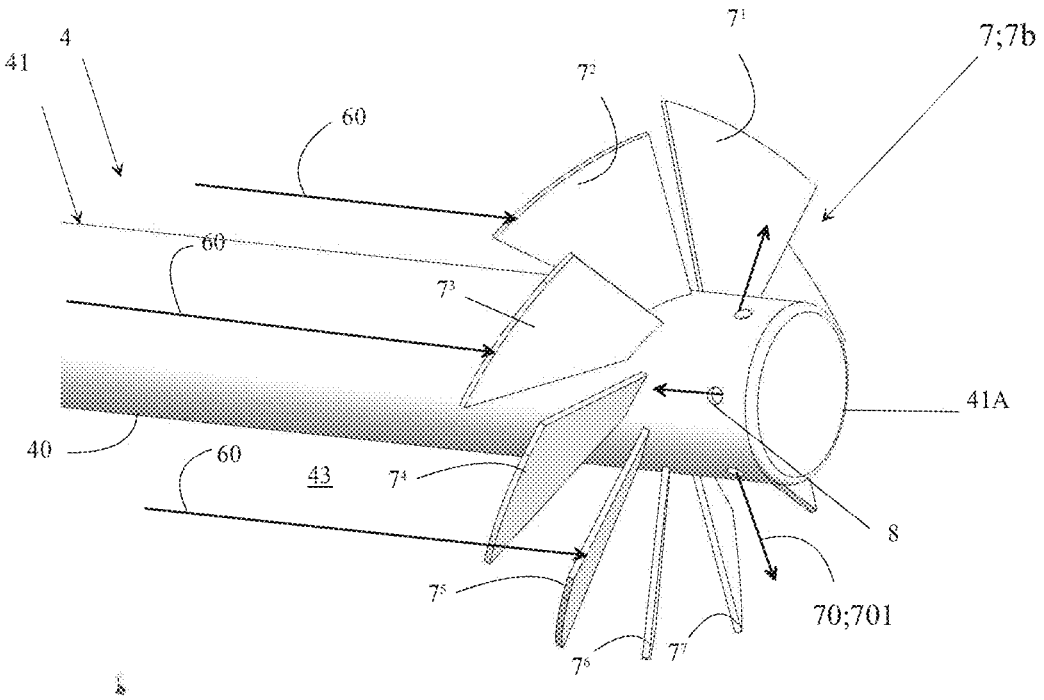
FIG. 2A shows, in an inclined front view, one embodiment for a flow controller located at the combustion head of a burner according to the invention.
Figure 2B:
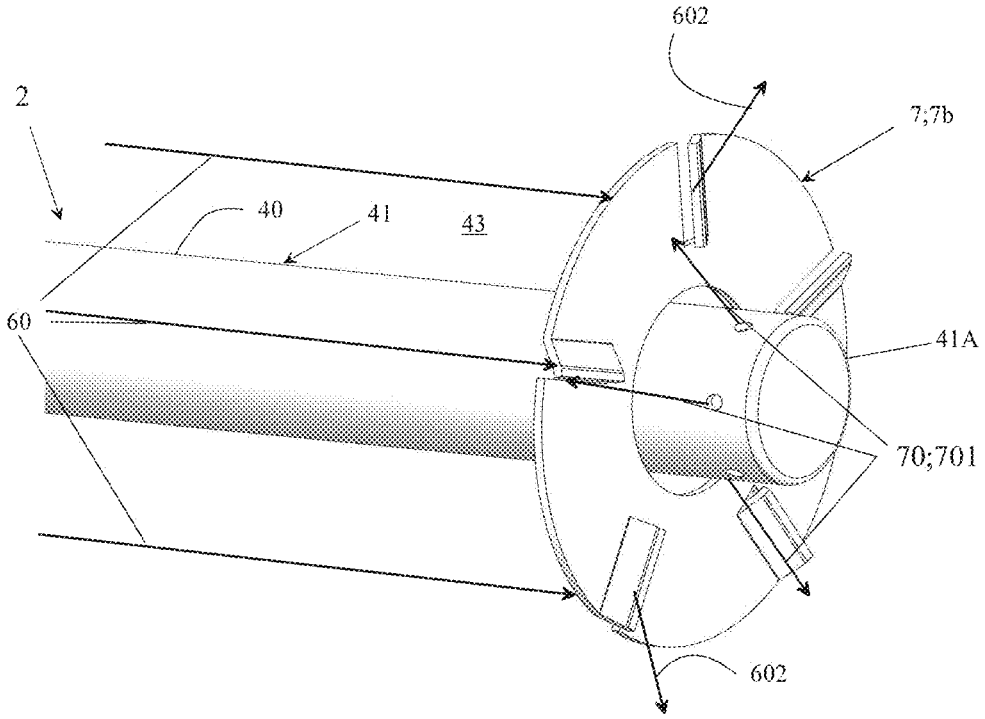
FIG. 2B shows, likewise in an inclined front view, another embodiment for a flow controller located at the combustion head of a burner according to the invention.
Figure 2C:
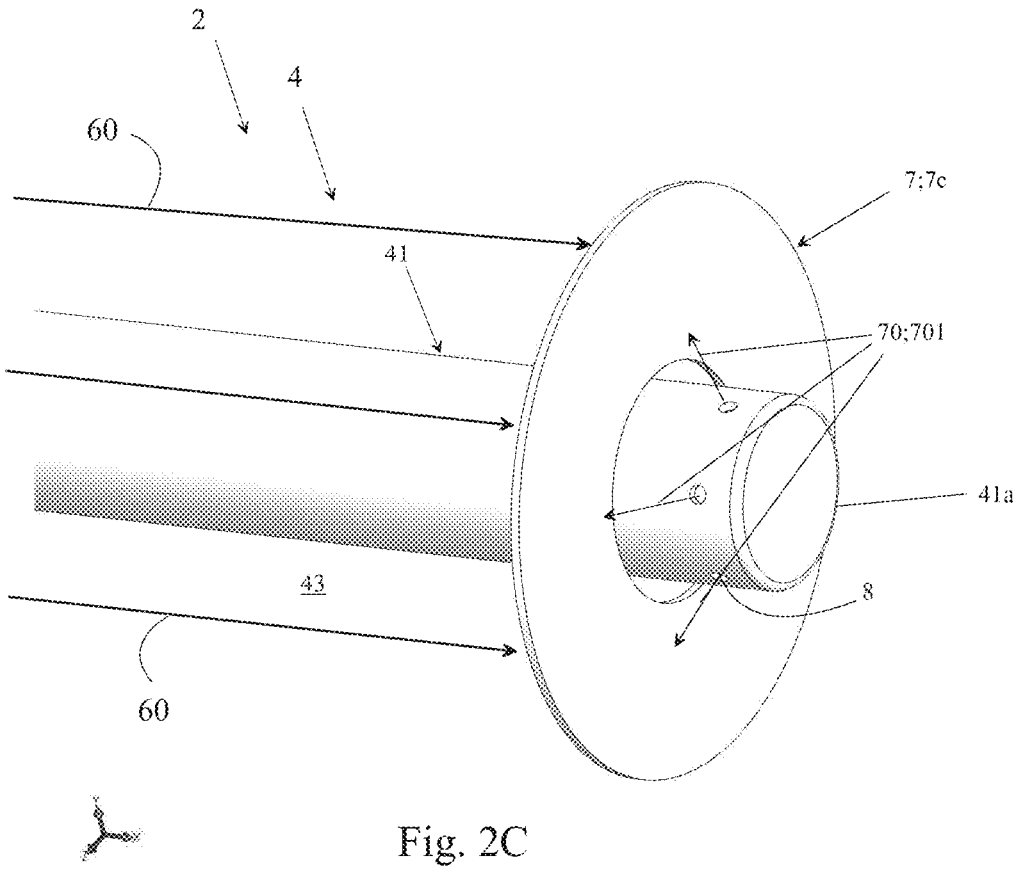
FIG. 2C shows, in an inclined front view, still another embodiment for a flow controller located at the combustion head of a burner according to the invention.

FIGS. 2A, 2B and 2C illustrate, in a view obliquely from the front, the structural and functional options for a flow controller 7 fitted in the inner channel's flow space 43 of a burner of the invention. In each figure is further sketched a flow of primary air 60 arriving at the flow controller 8, as well as a flow of primary gas 70; 701 arriving in the same flow space 43 from the inner tube 4; 41.

As depicted in FIG. 1, the flow of primary air 60 is adapted to flow from the burner's frame member 6 into the flow space 43 and further through the flow controller 7.

The flow controller 7, used for directing the primary air 60, may come in diverse designs and shapes, the most important aspect being, however, that the flow of primary air 6, arriving at the flow controller 7 from the flow space 43, will be directed by the flow controller 7 towards the main flame B and the outer wall of the flow space, which is at the same time the jacket 42*a* of the outer tube. The main flame is generated by means of an air-fuel mixture 80 flowing in the discharge channel 10.

The flow controller 7; 7*a* may comprise, as depicted for example in FIG. 2A, a plurality of vanes $7^1$, $7^2$, $7^3$ . . . $7^n$. The flow controller's 7; 7*a* vanes $7^1$, $7^2$, $7^3$ . . . $7^n$ are fitted to encircle the inner tube 4; 41 at an equal distance from a free end 41A of the inner tube 41. Relative to the flow of primary air 60 passing through between two adjacent vanes (e.g. $7^1$ and $7^2$ or $7^2$ and $7^3$), each vane $7^1$, $7^2$, $7^3$ . . . $7^n$ has its surface area and orientation adapted to be such that, downstream of the vanes 7, said flow of primary air 60 is directed towards the mouth 23 of the flow space 43, and at the same time that of the combustion head 2, co-directionally with the main flame B. Preferably, the flow of primary air 60 is directed to the proximity of the outer tube's 4; 42 internal surface by the action of the flow controller 7.

The vanes $7^1$, $7^2$, $7^3$ . . . $7^n$ are at least in a partially crosswise orientation with respect to the flowing direction 60 of primary air 60 in the flow space 43. Preferably, the vanes $7^1$, $7^2$, $7^3$ . . . $7^n$ are at an angle of 20-90 degrees relative to the primary air's flowing direction 60.

In FIG. 2B, the flow controller 7; 7*b* consists of single circular shaped disc surrounding the inner tube 41, and disc's plane is in a transverse direction relative to a lengthwise direction of the inner tube 41. The disc includes slots in its radial direction at a distance from each other, whereby the flow of primary air 60 arriving at a bottom surface of the disc will be directed from the slots towards the mouth 23 of the flow space 43 co-directionally with the main flame B.

FIG. 2C shows still another embodiment for a flow controller 7*c*. The flow controller 7; 7*c* consists of a single circular shaped disc surrounding the inner tube 41, and the disc's plane is in a transverse direction relative to a lengthwise direction of the inner tube 41. The flow of primary air 60 arriving at a bottom surface of the disc circumvents the disc and is directed towards the mouth 23 of the flow space 43 co-directionally with the main flame B.

Next follows a still further review of a few important details of the invention with reference to the preceding description of the FIGS. 1, 2A, 2B, 2C.

The flow space 4; 43 enlarges when proceeding towards the combustion head's 2 mouth 23, because the free end 42A of the outer tube's jacket 42 curves away as viewed from a center line P of the combustion head 2.

It is by virtue of the reliable main flame B adjustment that enables the burner to attain a 5 ppm emission limit with acceptable stability in several combustion chambers that were earlier difficult to control. In addition to this, the novel concept enables attainment of a NOx level of <2.5 ppm (O2 ref 3%) in the combustion chamber by virtue of further optimized flame stabilization and phasing of mixture ratios.

In order to generate a primary flame E, the amount of supplied primary air 60 is 5-30% of the total amount of air delivered into the burner's combustion head 2, and it is the adjustment of the relative amount and flow rate of primary air 60 and primary gas 70 that enables precise control of the intensity of primary flame E. This provides a major contribution to the intensity and stability of the main flame B. Preferably, the amount of primary air 60 supplied for generating the primary flame E is about 20% of the total amount of air used for generating a main flame B by means of a premixed air-gas mixture 80 as well as for generating a primary flame E by means of primary air 60.

All the premixed air and fuel is delivered into the site of a main flame B or into a B-zone in FIG. 1, most of the burning talking place within this zone. At the combustion head's mouth 23 develops a primary flame E, whose intensity and amount of air can be adjusted for making a difference regarding the temperature of a flue gas flowing into the main flame B zone. This way, the burner's 1 stability and emissions can be optimized for various applications and combustion chambers. It is by virtue of good adjustability that the burner is better-than-before compatible with diverse applications and combustion chambers. In particular, the burner is more compatible than before with water-tube boilers and other special applications.

In an A-flame zone, visible in FIG. 1, there also occurs some burning, the fuel and air ending up in the A-flame zone from the main flame's B-zone. The flue gas circulates in the A-zone and simultaneously cools down. The flue gas, which has cooled down in the A-zone, eventually returns into the B-zone, lowering at the same time the main flame temperature and reducing the burner's NOx emissions. It is also from zone C of a flame C that into the main flame's B-zone flows some partially cooled flue gas, which both dilutes and cools down the B-zone, cooling the flame's temperature profile and thereby reducing the burner's NOx emissions.

In front of the combustion head's 2 mouth 23 there is a strong backflow. The flue gas discharges from the main flame's B-zone along the furnace's 9 walls, while cooling down at the same time, and a portion thereof returns back by way of a middle section of the combustion chamber 9 in the form of a backflow D-C. The backflow D-C both cools down and dilutes the B-zone established by the main flame. In a D-zone of the flame, at an end of the combustion chamber 90, there are no significant backflows, yet there still occurs some complete combustion of carbon monoxide.

In the burner-furnace combination according to the invention, thanks to the radial direction of the fluids, the flame becomes very different when compared with competing technologies. The flame becomes compact (wide and short) but still surprisingly large in volume. Increasing the diameter of the flame will affect the volume of the flame more than increasing the length. (Cylinder volume=PI*(D/2)^2*)

Because of the shape of the flame, the return flows (A and D) dilute and cool the flame more efficiently than in competing technologies. These differences provide the following advantages: the flame is cool, and therefore the NOx emissions are low.

If the burner is used with high excess air, a smaller excessive air quantity will be sufficient to achieve the require NOx emission. If the burner is used in combination with external flue gas recirculation (FGR), a smaller amount of recirculated flue gas will be sufficient. Moreover, a shorter flame is advantageous in many applications, because a shorter furnace is sufficient.

With the exemplary burner-furnace combination according to the invention, low Nox values were achieved, thanks to the design of the combustion head and the shape of the resulting flame. Table 1 gives the quantity of Nox emissions resulting from flue gases of the furnace as a function of excess oxygen [dry, mol-%].

TABLE 1

| Oxygen excess | |
|---|---|
| $O_2$ [dry mol-%] | NOx [ppm, dry, $O_2$ = 3%] |
| 6 | <9 |
| 7 | <5 |
| 8 | <2.5 |

REFERENCE NUMERALS FOR MAIN COMPONENTS

Burner 1
Combustion head 2
  distal end 2*a*
  section of combustion head upstream of combustion chamber 2*b*
  mouth 23
Outer channel 3
  free end 3A
  external wall 31
    interior 30
    free end 31A
Inner channel 4
  inner tube; 41
    jacket 41*a*
    external wall 40
  outer tube 42
    free end 42A
    jacket 42*a*
  flow space 43
  free end 43*a*
Burner's frame member 6
Flow controller 7
  vanes $7^1$, $7^2$, $7^3$ . . . $7^n$ Nozzles 8
Furnace 9
interior, combustion chamber 90
Flange for a joint between furnace and burner 91
Discharge channel 10
discharge end 10*a*
Primary air 60
Primary air discharging from the mouth 602
Primary gas 70
primary gas discharging into the flow space 701
Premixed air-fuel mixture 80
Reverse flame A
Main flame B
Side flame immediately behind primary flame C
More distant side flame behind primary flame D
Primary flame E
Longitudinal center line of the combustion head P
Radius of curvature for the outer channel's free end R
Radius of curvature for the outer tube's free end R1
Center line of the discharge channel 10L
Center line of the discharge end 10A

The invention claimed is:

1. A burner (1) installable to a furnace (9) for burning an air-fuel mixture and for generating a flame in the furnace (9), said burner (1) comprising a frame member (6) provided with an elongated combustion head (2) protruding from said frame member (6) and being adaptable inside the furnace (9), a distal end (2*a*) of said combustion head (2), relative to the frame member being adaptable to generate both a main flame (B) and a primary flame (E), said combustion head (2) comprising an outer, larger diameter channel (4), surrounded by said outer channel (3), for a mixture (80) of combustion air and fuel, as well as a smaller diameter, inner channel (4), surrounded by said outer channel (3), for primary air (60) as well as for primary gas (70), whereby the inner channel (4) extends from the burner's frame member (6) to the distal end (2*a*) and comprises an inner tube (4, 41) for primary gas (70) and an outer tube (4; 42) surrounding said inner tube (4; 41); wherein a flow space (4; 43) for primary air (60) is provided between the outer side of the jacket (41*a*) of said inner tube and the inner side of the jacket of the outer tube, and which combustion head's (3) outer channel (3) extends from the burner's frame member (6) to the combustion head's distal end (2*a*) and can be provided with a supply of premixed air-fuel mixture (80) from the burner's frame member (6), or from that section of the combustion head (2) which is associated with the frame member and located, in the flowing direction of the premixed air-fuel mixture (80), upstream of a combustion chamber (90), for generating the main flame (B), characterized in that the space delimited by an outer wall (31) of the outer channel (3) and the jacket of the outer tube (42) of the inner channel (4) is constructed as a discharge channel (10) extending from the frame member (6) to the distal end (2*a*) of the combustion head (2), whereby the discharge end (10*a*) of said discharge channel is veered away from the longitudinal center line (P) of the combustion head (2) so that the center line (10A) of said discharge end (10*a*), or an extension thereof, forms an inclined angle of incidence (t) with the combustion head's (2) longitudinal center line (P), said angle of incidence (t) being 90-140 degrees as said discharge end (10*a*) of the discharge channel (10) is viewed from the direction of the burner's (1) frame member (6), a flow controller (7) is provided in the flow space (4; 43) for primary air, at the distal end (2*a*) of the combustion head (2), for directing the flow of primary air (60) in the flow space (43) so that the primary air (60) flows from the flow controller (7) towards a mouth (43*a*) of the flow space (43), in the vicinity of a jacket (42*a*) of the outer tube (4; 42) of the inner channel (4), a plurality of nozzles (8) are provided in the inner tube (4; 41) of the inner channel (4), at the distal end (41*a*) of said inner tube (4) in the flowing direction of the primary gas (70), for directing the primary gas (70) into the flow space (4; 43), either upstream or downstream of the flow controller (7) in the flowing direction of the primary air (60).

2. A burner (2) according to claim 1, characterized in that the outer wall (31) of the outer channel (3), which is simultaneously the outer wall (10*d*) of the discharge channel (10), veers outward from the longitudinal center line (P) of the combustion head (3) at the discharge end (10*a*), when said outer wall (10*d*) of the discharge channel (10) is seen from the direction of the frame member (6) of the burner.

3. A burner (2) according to claim 1, characterized in that an inner wall (10*c*) of the discharge channel (10), which is simultaneously the jacket of the outer tube (42) of the inner channel (4), veers outward from the longitudinal center line (P) of the combustion head (2) at the discharge end (10*a*), when said inner wall of the discharge channel (10), or jacket of the outer tube (42*a*), is seen from the direction of the frame member (6) of the burner.

4. A burner according to claim 1, characterized in that a mouth (23) of the combustion head (2) comprises a mouth (10*a*) of the discharge channel (10) and the mouth (43*a*) of the flow space (43).

5. A burner (2) according to claim 1, characterized in that the flow controller (7) comprises a plurality of vanes ($7^1$, $7^2$, $7^3$ . . . $7^n$), whose surface area and orientation, relative to the flow of primary air (60) passing through between the same, have been adapted to be such that the flow of primary air (60) is directed, downstream said vanes, towards a mouth of the flow space (43), discharging into the combustion chamber (90) co-directionally with the main flame (B).

6. A burner according to claim 1, characterized in that the flow controller (7) is made up of a circular shaped disc encircling the inner tube (4; 41), the plane of said disc being transversely directed with respect to a lengthwise direction of the inner tube (4; 41).

7. A burner (1) according to claim 5 or 6, characterized in that the flow controller (7) comprises a disc or vanes ($7^1$, $7^2$, $7^3$ . . . $7^n$), which is/are mounted to encircle the inner tube (41) of the inner channel (4) at an equal distance from a free end (41A) of the inner tube, said disc or said vanes ($7^1$, $7^2$, $7^3$ . . . $7^n$) being at least partially transversely directed with respect to the flowing direction of the primary air (60).

8. A burner (1) according to claim 7, characterized in that the vanes ($7^1$, $7^2$, $7^3$ . . . $7^n$) of the plurality of vanes are at an angle of 20-90 degrees relative to the flowing direction of primary air (60).

9. A burner (1) according to claim 1, characterized in that the flow space (4; 43) enlarges in the direction of the mouth (43*a*) of the flow space (43), which mouth (43*a*) is encircled by the inner walls of the discharge channel (10) at the discharge end (10*a*).

10. A burner (1) according to claim 1, characterized in that the plurality of nozzles (8) in the proximity of a free end of the inner tube (4), are adapted to direct the primary gas (70) from the inner tube (4; 41) into the flow space (43) or to the mouth (43*a*) f the flow space (43) in the flowing direction of primary air (60) upstream or downstream of the flow controller (7) located at a free end (2*a*) of the combustion head of the flow space (43).

11. A burner (1) according to claim 1, characterized in that the discharge channel (10) is adapted to become narrower and to veer away, as viewed from a center line (P) of the combustion head, when proceeding in the traveling direction of the premixed air-gas mixture (80) towards a mouth of the discharge channel's (10) discharge end (10*a*).

12. A burner according to claim 11 characterized in that the cross-sectional area of the discharge end (10*a*) of the discharge channel (10) diminishes in the traveling direction of the premixed air-gas mixture (80) when proceeding towards the mouth of the discharge end (10*a*) which remains outside the inner wall (10*c*) of the discharge channel (10).

13. A burner (1) according to claim 11, characterized in that the external wall (10*d*) of discharge end (10*a*) of the discharge channel (10) is located on such a circular arc which has a radius R, and the inner wall of the discharge end (10*a*) of the discharge channel (10) is located on such a circular arc which has a radius R1, whereby the centers of the radii R and R1 are located outside the combustion head (2).

14. A burner (1) according to claim 11, characterized in that the discharge channel's (10) external wall (31) and the discharge channel's (10) internal wall (42*a*) are curving outward as viewed from the combustion head's center line (P) with a radii of curvature (R) and (R1) being equal or unequal.

15. A burner (1) according to claim 14, characterized in that the internal wall (42) of the discharge end (10*a*) of the discharge channel (10), which has the radius of curvature (R1), curves more vigorously outward, seen from the center line (P) of the combustion head, than the external wall (31) of the discharge end (10*a*) of the discharge channel (10), which has the radius of curvature R, whereby R1>R.

16. A furnace-burner assembly for burning the air-fuel mixture (80) and for generating the flame (B, E) in a combustion chamber (90) present inside the furnace, said burner (1) having been defined in claim 1 and connected to a furnace (9) in such a way that a first section of the elongated combustion head (2) is located outside the furnace (9) or connectable to structures of the furnace (9) and a second section of the elongated combustion head (2) is located inside the furnace (9), which protrudes from a frame member (6) and which combustion head (2) has its first section left outside the furnace (9) or connected to structures of the furnace (9), characterized in that the main flame (B) is generable by conducting some premixed air-fuel mixture (80) into the discharge channel (10), from the mouth of discharge channel's discharge end (10*a*) said fuel-air mixture (80) discharges into the combustion chamber (90), whereby the center line (10A), or its extension, of said discharge end (10*a*) forms an inclined angle of incidence (t), which angle (t) is about 90-140 degrees, with the longitudinal center line (P) of the combustion head (2), as well as also with the longitudinal center line (10L) of the discharge channel (10), as said discharge end (10*a*) for the discharge channel (10) is viewed with the direction of the burner's 1 frame member 6, and the primary flame (E) is generable by providing the flow space (4; 43) with the supply of primary air (60) from the burner's (1) frame member (6) or from that section of the combustion head (2) which is associated with the frame member and located, in the flowing direction of primary air (60), upstream of the combustion chamber (90), for conveying the flow of primary air (60) to the flow controller (7) which is adapted to direct the flow of primary air (60) to pass towards a mouth of the flow space (43) co-directionally with the main flame (B), and by providing an inner channel's (4) inner tube (4; 41) with the supply of primary gas (70) from the burner's (1) frame member (6) or from the section of the combustion head (2) which is located, in the flowing direction of primary air (60), upstream of the combustion chamber (90), whereby the nozzles of a plurality of nozzles (8) in the proximity of a free end (4*a*) of the inner tube (4; 41) are adapted to direct the primary gas (70) to discharge from the combustion head's mouth (2*a*) into the flow space (4; 43).

17. A furnace-burner assembly according to claim 16, characterized in that the primary gas (70) is delivered from the inner tube (4; 41) by means of the nozzles (8) into the flow space (4; 43) in the flowing direction of the primary air (60) upstream or downstream of the flow controller (7) located at a free end (43*a*) of the flow space (4; 43).

18. A furnace-burner assembly according to claim 16, characterized in that the discharge channel (10) becomes narrower and veers outward, as viewed from the center line (P) of the combustion head (2), when proceeding, in the traveling direction of the premixed air-gas mixture (80), towards the discharge channel's (10) discharge end (10*a*), whereby speed of said air-gas mixture (80) increases as it flows towards a mouth of the discharge channel's (10) discharge end (10*a*).

19. A furnace-burner assembly according to claim 16, characterized in that the flame's backflow, jointly with the flow controller (7), is adapted to direct the flow of primary air (60), proceeding by way of the flow controller (7), towards a mouth of the flow space (43) in the proximity of the outer tube's internal surface.

20. A furnace-burner assembly according to claim 16, characterized in that the intensity and stability of the primary flame (E) are controllable by adjusting the amount and speed of primary air (60) and primary gas (70).

21. A furnace-burner assembly according to claim 16, characterized in that the amount of primary air (60) supplied for generating the primary flame (E) is 5-30% of the total amount of air, which is used for generating the main flame (B) by means of the premixed air-gas mixture (80), as well as for establishing the primary flame (E) by means of the primary air.

* * * * *